US012312782B2

(12) United States Patent
Erickson

(10) Patent No.: US 12,312,782 B2
(45) Date of Patent: May 27, 2025

(54) SLOW CLOSE INSERT FOR FAUCETS

(71) Applicant: Kohler Co., Kohler, WI (US)

(72) Inventor: Perry D. Erickson, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 353 days.

(21) Appl. No.: 17/575,434

(22) Filed: Jan. 13, 2022

(65) Prior Publication Data

US 2022/0243433 A1 Aug. 4, 2022

Related U.S. Application Data

(60) Provisional application No. 63/143,150, filed on Jan. 29, 2021.

(51) Int. Cl.
*E03C 1/04* (2006.01)

(52) U.S. Cl.
CPC .... *E03C 1/0404* (2013.01); *E03C 2001/0415* (2013.01)

(58) Field of Classification Search
CPC .. E03C 1/0404; E03C 1/06; E03C 2001/0415; E05F 5/08
USPC ..... 4/678
See application file for complete search history.

(56) References Cited

U.S. PATENT DOCUMENTS 2,026,327 A 12/1935 Sparling
2,095,241 A 10/1937 Cox
2,875,496 A 3/1959 Fox
3,612,318 A 10/1971 Ramsey
4,360,159 A 11/1982 Haynes
4,446,884 A 5/1984 Rader, Jr.
5,117,859 A 6/1992 Carlson
5,775,354 A 7/1998 Upton
(Continued)

FOREIGN PATENT DOCUMENTS

BR 112018005774 10/2018
CA 2522873 A1 9/2004
(Continued)

OTHER PUBLICATIONS

Intellectual Property India, "India Examination and Search Report dated Oct. 3, 2022", Application No. 202214003582, 7 pages.
(Continued)

*Primary Examiner* — Tuan N Nguyen
(74) *Attorney, Agent, or Firm* — Husch Blackwell LLP

(57) ABSTRACT

A faucet assembly includes a spout, a hand-held sprayer, and a slow-close insert. The hand-held sprayer is coupled to a hose that extends through the spot and movable between a retracted position in which a portion of the hand-held sprayer is located within the spout and an extended position. The slow-close insert includes an inner sleeve and a spring. The inner sleeve is disposed at least partially within the spout and operable between a first position and a second position. The inner sleeve includes a jaw configured to engage the portion of the hand-held sprayer when the inner sleeve is in the first position and release the portion of the hand-held sprayer when the inner sleeve is in the second position. The spring is configured to assist movement of the inner sleeve between the first position and the second position.

7 Claims, 8 Drawing Sheets

(56) References Cited

U.S. PATENT DOCUMENTS

| | | | |
|---|---|---|---|
| 5,934,325 | A | 8/1999 | Brattoli |
| 6,234,192 | B1 | 5/2001 | Esche et al. |
| 6,588,453 | B2 | 7/2003 | Marty et al. |
| 6,738,996 | B1 | 5/2004 | Malek et al. |
| 6,810,539 | B2 | 11/2004 | Bosio |
| 6,845,526 | B2 | 1/2005 | Malek et al. |
| 6,877,172 | B2 | 4/2005 | Malek et al. |
| 6,915,816 | B2 | 7/2005 | Nelson et al. |
| 6,915,817 | B2 | 7/2005 | Benstead et al. |
| 7,699,241 | B2 | 4/2010 | Benstead |
| 7,997,301 | B2 | 8/2011 | Marty et al. |
| 8,091,929 | B2 | 1/2012 | Lorch |
| 8,104,512 | B2 | 1/2012 | Nelson et al. |
| 8,800,075 | B2 | 8/2014 | Van Leyen et al. |
| 8,875,738 | B2 | 11/2014 | Yang et al. |
| 9,062,790 | B2 | 6/2015 | Esche et al. |
| 9,175,458 | B2 | 11/2015 | Meehan et al. |
| 9,194,109 | B2 | 11/2015 | Ho |
| 9,259,744 | B2 | 2/2016 | Hansen |
| 9,334,635 | B2 | 5/2016 | Keiter et al. |
| 9,683,353 | B2 | 6/2017 | Myers et al. |
| 9,695,580 | B2 | 7/2017 | Esche et al. |
| 9,840,831 | B1 | 12/2017 | Esche et al. |
| 9,988,796 | B2 | 6/2018 | Bosio |
| 10,184,231 | B2 | 1/2019 | Pitsch et al. |
| 10,526,773 | B2 | 1/2020 | Mu et al. |
| 10,669,701 | B2 | 6/2020 | Hadfield et al. |
| 10,745,895 | B2 | 8/2020 | Li |
| 10,781,579 | B2 | 9/2020 | Mu et al. |
| 11,053,670 | B2 | 7/2021 | Tracy et al. |
| 11,208,792 | B2 | 12/2021 | Myers et al. |
| 2004/0135010 | A1 | 7/2004 | Malek et al. |
| 2006/0202142 | A1 | 9/2006 | Marty et al. |
| 2007/0245487 | A1 | 10/2007 | Zhou |
| 2013/0037626 | A1 | 2/2013 | Van et al. |
| 2014/0150896 | A1 | 6/2014 | Chu et al. |
| 2015/0333360 | A1 | 11/2015 | Tajima et al. |
| 2016/0083942 | A1 | 3/2016 | Li |
| 2016/0237661 | A1 | 8/2016 | Teagarden |
| 2017/0096801 | A1 | 4/2017 | Pitsch et al. |
| 2017/0314241 | A1 | 11/2017 | Myers et al. |
| 2018/0080203 | A1 | 3/2018 | Frye |
| 2019/0071851 | A1 | 3/2019 | Meehan et al. |
| 2019/0382990 | A1 | 12/2019 | Tracy |
| 2020/0063408 | A1 | 2/2020 | Tracy et al. |
| 2020/0378097 | A1 | 12/2020 | Li |
| 2021/0381208 | A1* | 12/2021 | Lee ..... E03C 1/0404 |
| 2021/0404156 | A1 | 12/2021 | Tracy et al. |

FOREIGN PATENT DOCUMENTS

| | | | |
|---|---|---|---|
| CA | 3000652 | A1 | 4/2017 |
| CN | 1675435 | A | 9/2005 |
| CN | 202629230 | U | 12/2012 |
| CN | 203034539 | U | 7/2013 |
| CN | 203096843 | | 7/2013 |
| CN | 204628794 | U | 9/2015 |
| CN | 205244538 | U | 5/2016 |
| CN | 105756143 | A | 7/2016 |
| CN | 105822791 | A | 8/2016 |
| CN | 106715806 | A | 5/2017 |
| CN | 107489189 | A | 12/2017 |
| CN | 108290702 | A | 7/2018 |
| CN | 110063675 | A | 7/2019 |
| CN | 110440044 | | 11/2019 |
| CN | 112262008 | | 1/2021 |
| DE | 11 2004 000 418 | | 1/2006 |
| DE | 20 2005 019 492 | U1 | 2/2006 |
| EP | 1 418 008 | A1 | 5/2004 |
| GB | 2 415 484 | A | 12/2005 |
| GB | 2 426 809 | A | 12/2006 |
| GB | 2 435 502 | | 8/2007 |
| JP | 2003-027539 | | 1/2003 |
| JP | 6783854 | B2 | 10/2018 |
| MX | 2018003825 | A | 3/2018 |
| WO | WO 2004/081437 | | 9/2004 |
| WO | WO-2014/130816 | | 8/2014 |
| WO | WO 2017/058566 | | 4/2017 |
| WO | WO-2017/058566 | A1 | 4/2017 |

OTHER PUBLICATIONS

European Search Report corresponding to EP 22151749.3 dated Aug. 8, 2022.

China Office Action corresponding to CN 202210104872.7, dated Sep. 28, 2023.

English Summary of Chinese Office Action corresponding to CN 202210104872.7, dated Sep. 28, 2023.

First Office Action CN Appl. Ser. No. 201710415057.1 dated Apr. 9, 2019 (6 pages).

International Search Report and Written Opinion on Appl. Ser. No. PCT/CN2021/090781 dated Dec. 29, 2021 (11 pages).

Foreign Search Report on PCT PCT/CN2022/076972 Dtd May 18, 2022.

China Office Action corresponding to CN 202210104872.7, dated Apr. 30, 2024.

English summary of China Office Action corresponding to CN 202210104872.7, dated Apr. 30, 2024.

* cited by examiner

SLOW CLOSE INSERT FOR FAUCETS

CROSS REFERENCE TO RELATED PATENT APPLICATION

This application claims the benefit of and priority to U.S. Provisional Patent Application No. 63/143,150 filed Jan. 29, 2021, the entire disclosure of which is incorporated by reference herein.

BACKGROUND

The present disclosure relates generally to faucets. More specifically, the present disclosure relates to a slow-close insert for a hand-held spray assembly of a faucet.

SUMMARY

At least one embodiment relates to a faucet assembly. The faucet assembly includes a spout, a hand-held sprayer, and a slow-close insert. The spout includes an inner portion and an outer portion. The hand-held sprayer is coupled to a hose that extends through the spot and movable between a retracted position in which a portion of the hand-held sprayer is located within the spout and an extended position in which the portion of the hand-held sprayer is located outside of the spout. The slow-close insert includes an inner sleeve and a spring. The inner sleeve is disposed at least partially within the spout and operable between a first position and a second position. The inner sleeve includes a jaw configured to engage the portion of the hand-held sprayer when the inner sleeve is in the first position and release the portion of the hand-held sprayer when the inner sleeve is in the second position. The spring is coupled to the inner sleeve and configured to assist movement of the inner sleeve between the first position and the second position.

Another embodiment relates to a slow close mechanism. The slow close mechanism includes an outer sleeve, an inner sleeve, and one or more damping elements. The outer sleeve is coupled to an inner surface of a faucet. The inner sleeve is positioned within the outer sleeve and operable between an open position and a closed position. The one or more damping elements are configured to assist the slow close mechanism when the inner sleeve transitions between the open position and the closed position. Assisting the slow close mechanism includes at least one of damping movement of the inner sleeve between the open position and the closed position or biasing the inner sleeve into the closed position.

Another embodiment relates to a slow close mechanism. The slow close mechanism includes an outer sleeve, an inner sleeve, and a spring. The outer sleeve includes a track extending longitudinally along a length of the outer sleeve. The inner sleeve is at least partially disposed within the outer sleeve and repositionable between an open position and a closed position. The inner sleeve includes a channel extending longitudinally along a length of the inner sleeve. The spring is at least partially provided within the channel and configured to assist movement of the inner sleeve between the open position and the closed position. The inner sleeve is wholly received within the outer sleeve when the inner sleeve is in the closed position. The inner sleeve is partially received within the outer sleeve when the inner sleeve is in the open position.

This summary is illustrative only and should not be regarded as limiting.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Figure 1:
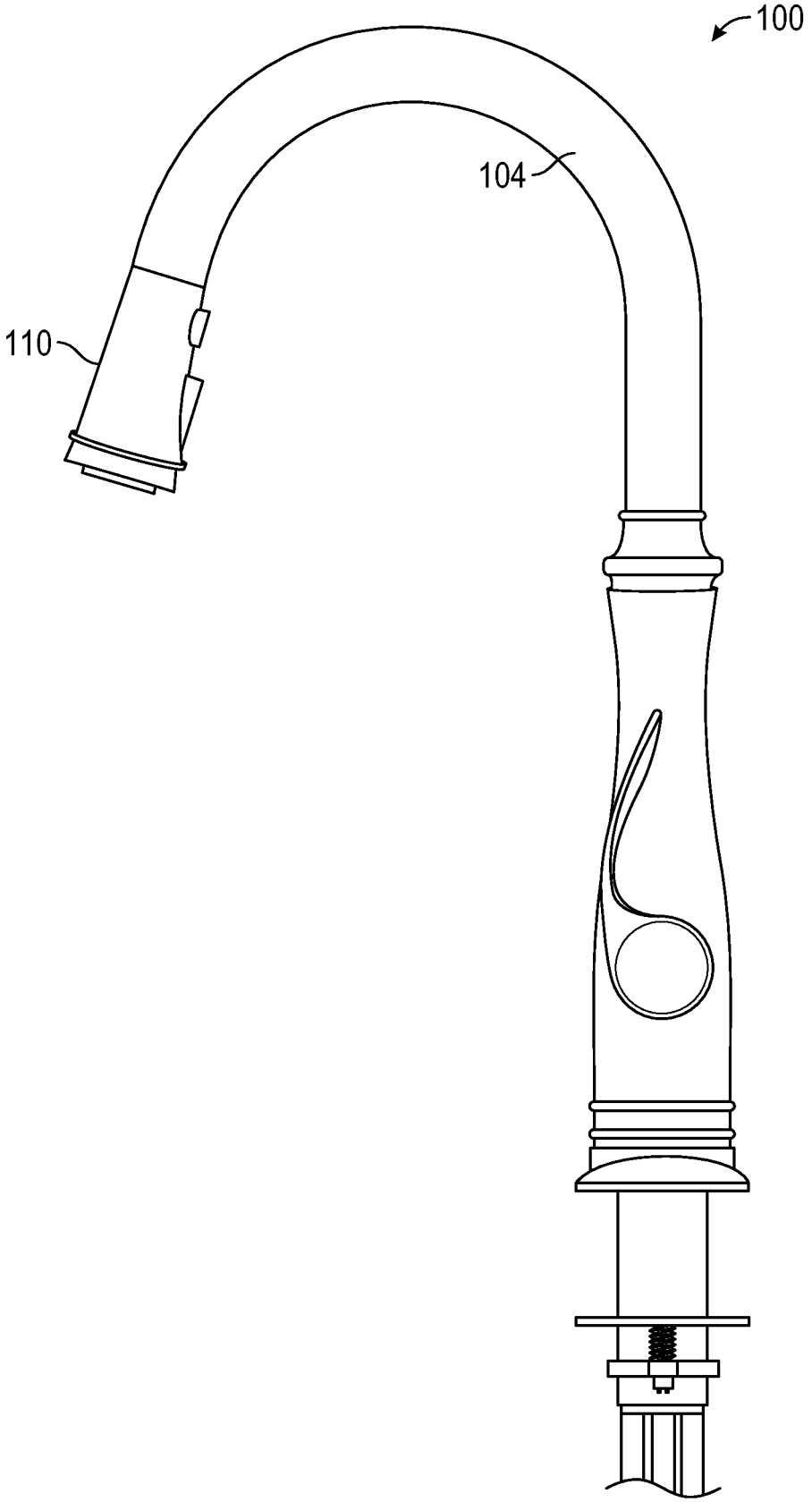
FIG. 1 is a side view of a faucet assembly, according to an exemplary embodiment.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Generally speaking, most traditional hand-held, pull-out sprayers are attached to a flexible hose and may be capable of extending away from a faucet via the flexible hose. Some hand-held sprayers are capable of automatically retracting back into the faucet (e.g., by a biasing force of the hose, etc.), so as to facilitate docking of the sprayer to the faucet. However, when the hand-held sprayer returns to the faucet when docking, the hand-held sprayer may experience excessive force and become damaged over time. Additionally, the hand-held sprayer may experience an insufficient force and not retract fully back into the faucet or be improperly docked. Therefore, it would be advantageous to provide a faucet assembly that is capable of receiving a hand-held sprayer and returning the hand-held sprayer to an original, docked position on the faucet without the use of excess force and in a more reliable and consistent manner, as compared some traditional hand-held, pull-out sprayers.

Referring generally to the figures, a faucet assembly 100 having a hand-held sprayer 110 is shown according to an exemplary embodiment. The hand-held sprayer 110 is biased to a retracted, docked position on the faucet such that a portion of the hand-held sprayer is flush with a portion of the spout 104 of the faucet assembly 100 using a slow-close insert assembly 200. The hand-held sprayer 110 is operable (e.g., by a user, etc.) from the retracted, docked position to an extended position via the slow-close insert assembly 200. In the extended position, the hand-held sprayer 110 is operable (e.g., by a user, etc.) to dispense water in a plurality of directions and/or a plurality of spray modes.

The slow-close insert assembly 200 includes an outer sleeve 210 and an inner sleeve 220. The outer sleeve 210 is structured to couple to an inner surface of the spout 104. The inner sleeve 220 is operable between a first position (e.g., a closed position) and a second position (e.g., an open position). The slow-close insert assembly 200 includes one or more damping elements (e.g., a spring, a damper, etc.) shown as springs 250, which can, advantageously, help to facilitate a slow-close action as the inner sleeve 220 transitions between the first position and the second position.

Referring now to FIG. 1, a side view of the faucet assembly 100 is shown. The faucet assembly 100 is structured to receive water at a proximal end from a supply line (e.g., a hot water supply line, a cold water supply line) and dispense the water at a distal end. The faucet assembly 100 includes a spout 104 and a hand-held sprayer 110. In some embodiments, the faucet assembly 100 may be configured to have an ornamental exterior (e.g., brass, stainless steel, etc.). In some embodiments, the faucet assembly 100 includes mounting hardware structured to couple the faucet assembly 100 to a counter top. In some embodiments, the faucet assembly 100 also includes various valves and/or handles structured to modify a parameter (e.g., flow rate, temperature, etc.) of water flowing through the faucet assembly 100. In additional embodiments, the ornamental exterior may be configured to match nearby fixtures in, for example, a kitchen environment. The faucet assembly 100 may be a pull-down faucet assembly in a kitchen, according to an exemplary embodiment. The faucet assembly 100 may be used in a variety of different environments, including kitchens, bathrooms, showers, or other types of environments.

Figure 2:
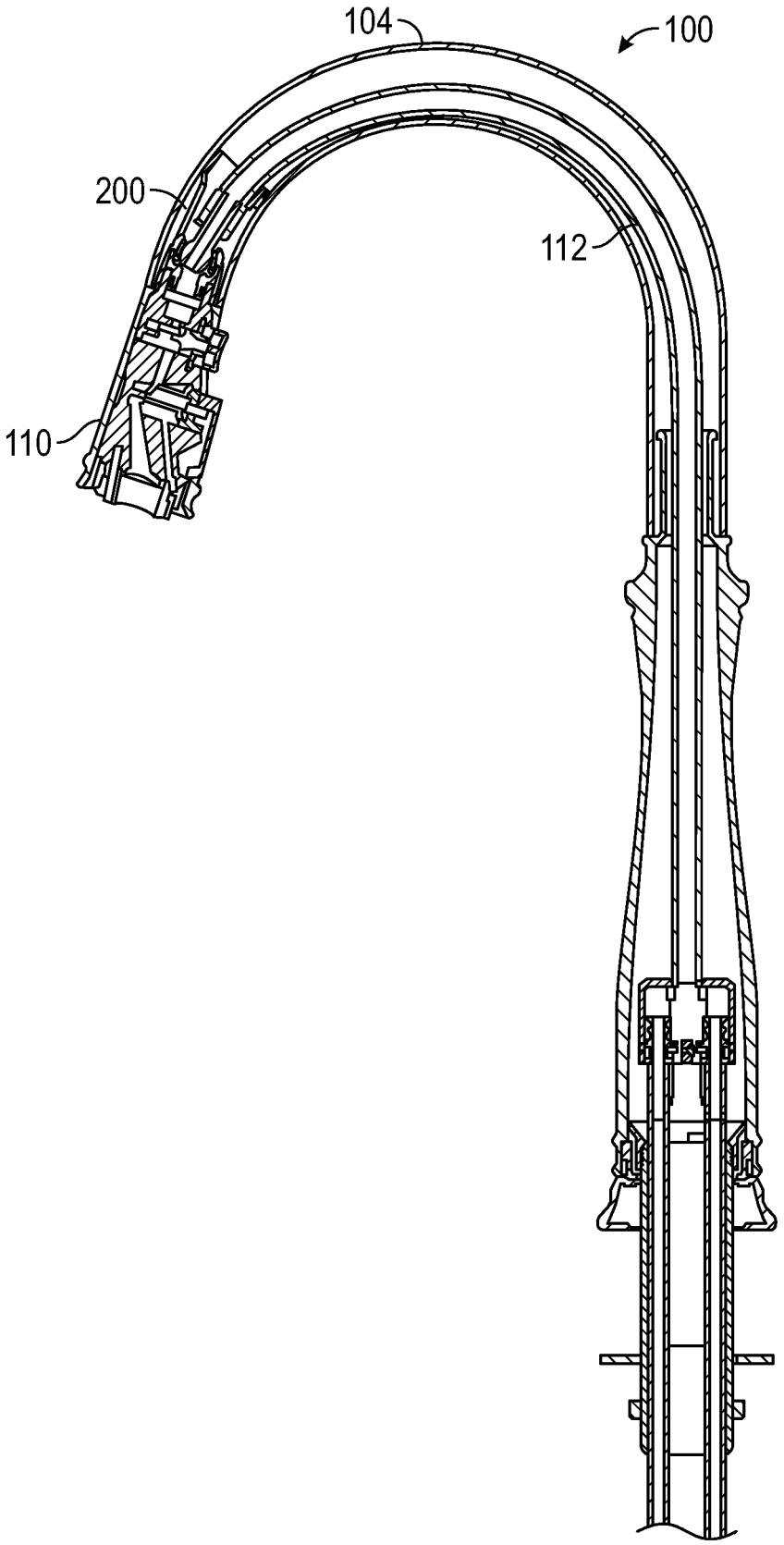
FIG. 2 is a cross section view of the faucet assembly of FIG. 1.

Referring now to FIG. 2, a cross section view of the faucet assembly 100 is shown. The faucet assembly 100 is shown to further include a hose 112 (e.g., flexible hose, etc.) that is structured to receive water from a water supply (e.g., a hot/cold supply line, downstream a mixing valve, etc.) and provide the water to the hand-held sprayer 110. The faucet assembly 100 is also shown to include a slow-close insert assembly 200 disposed at a distal end of the spout 104. As shown in FIGS. 1 and 2, the hand-held sprayer 110 is biased to a retracted position such that a portion of the hand-held sprayer 110 is flush with the spout 104 in a docked position on the spout 104. In the retracted or docked position, the hand-held sprayer is substantially stationary and is structured to dispense water received via the hose 112. The hand-held sprayer 110 is operable from the retracted to an extended position. In the extended position the hand-held sprayer 110 is operable to dispense water in a plurality of directions and/or a plurality of spray modes.

Figure 3:
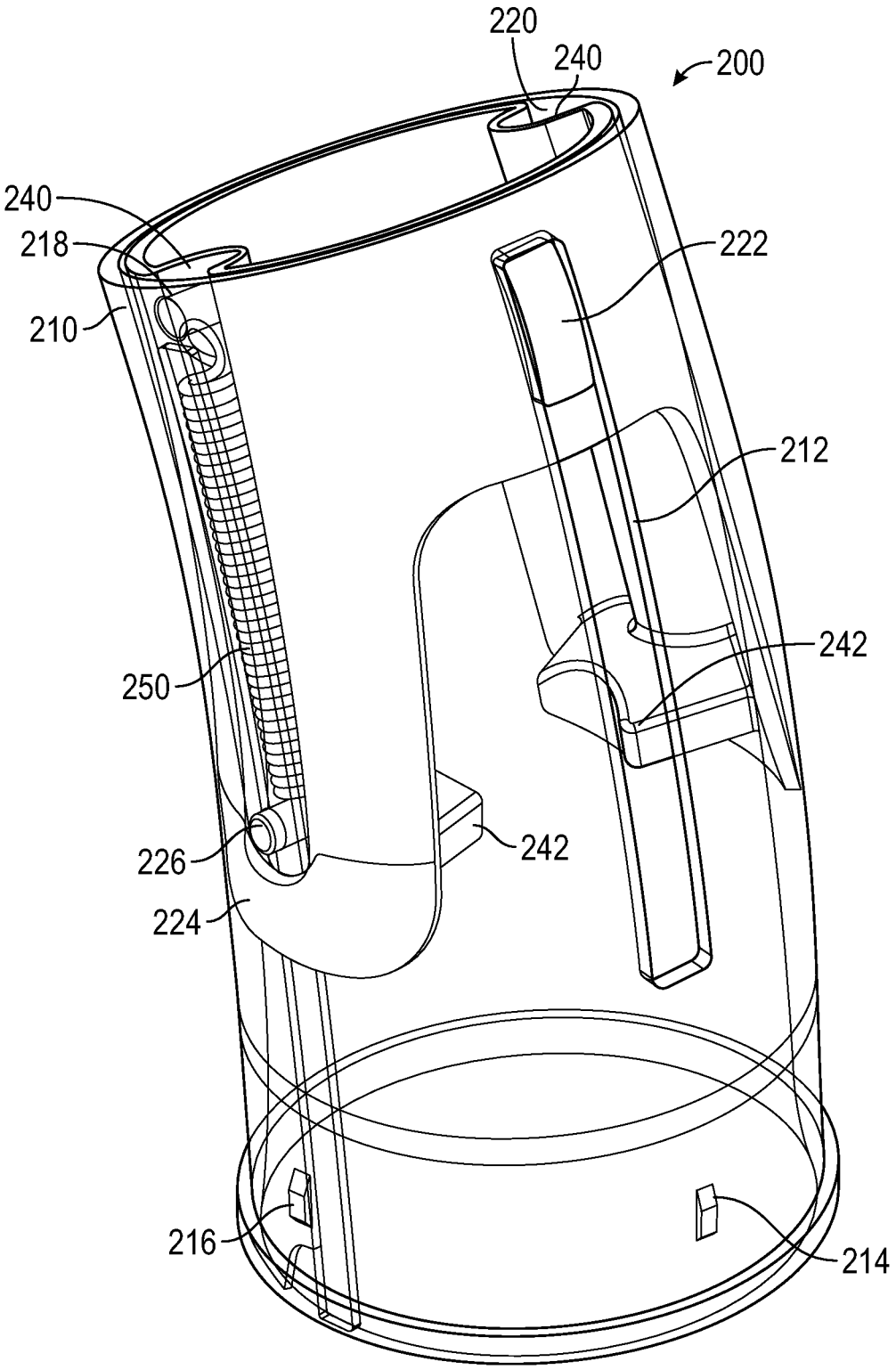
FIG. 3 is a perspective view of a slow-close insert assembly in a first position, according to an exemplary embodiment.
Figure 4:
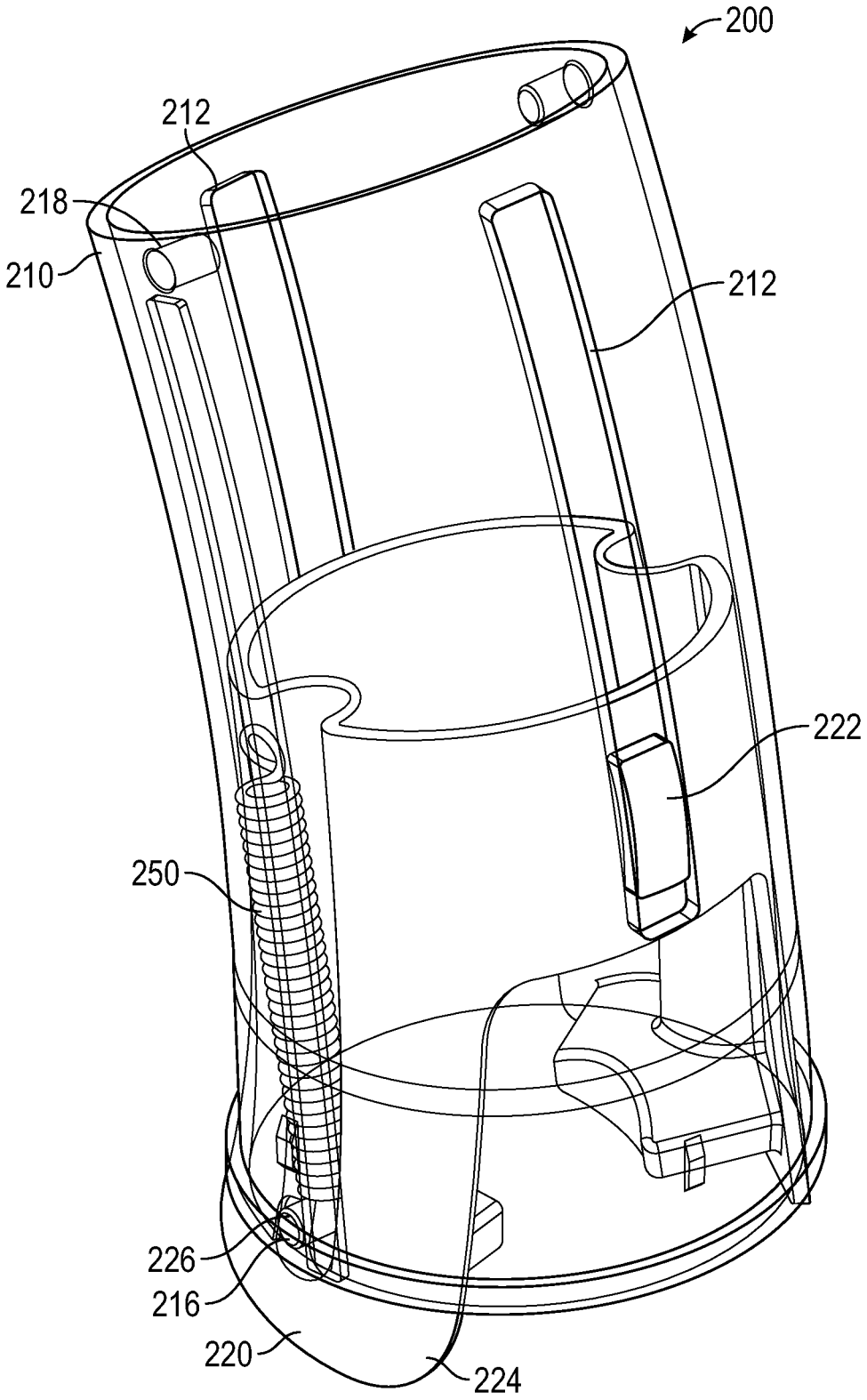
FIG. 4 is a perspective view of a slow-close insert assembly in a second position, according to an exemplary embodiment.

Referring to FIGS. 3-4, perspective views of the slow-close insert assembly 200 are shown, according to an exemplary embodiment. The slow-close insert assembly 200 includes an outer sleeve 210 and an inner sleeve 220. The inner sleeve 220 is positioned at least partially within the outer sleeve 210. In some embodiments, the outer sleeve 210 has a first annular wall and the inner sleeve 220 has a second annular wall. The first annular wall and the second annular wall define a central axis (shown as central axis 130 in FIG. 6). According to an exemplary embodiment, the inner sleeve 220 is operable between a first position (e.g., a closed position) shown in FIG. 3 and a second position (e.g., an open position) shown in FIG. 4. The slow-close insert assembly 200 is structured to be positioned at a distal end of a spout (e.g., the spout 104 of FIG. 1). In some embodiments, the outer sleeve 210 is at least partially flexible such that the outer sleeve 210 follows a curvature of a spout. Further, the central axis may be curved or arced in shape. Accordingly, the slow-close insert assembly 200 may be used in a wide variety of faucet assemblies having different spouts and/or spout curvatures.

The outer sleeve 210 includes a slot that defines a track 212. The track 212 may be positioned on a first surface of the outer sleeve and extend partially or fully through the first surface. The inner sleeve 220 includes a protrusion shown as key 222 that is positioned within the slot such that the key 222 moves along the track 212 as the inner sleeve 220 transitions between the first position and the second position.

The outer sleeve 210 also includes at least one tab 214. The tab 214 extends radially outward form the central axis. The tab 214 is structured to facilitate coupling the outer sleeve 210 to an inner surface of the spout 104. In some embodiments, the tab 214 is structured to snap-fit to the inner surface of the spout 104. According to other exemplary embodiments, the tab 214 facilitates an interference or press-fit arrangement with the inner surface of the spout 104.

The outer sleeve 210 also includes at least one retention slot 216. The retention slot 216 may be a hole formed through the outer sleeve 210. In some embodiments, the outer sleeve 210 includes two or more retention slots. The retention slot 216 is structured to receive an extended portion (e.g., pin, tab, or other protrusion), shown as pin 226 when the inner sleeve 220 is in the second position.

The outer sleeve 210 also includes at least one protrusion shown as retention notch 218. The retention notch 218 extends radially inward from an inner surface of the outer sleeve 210. The retention notch is structured to couple to a portion of a damping element shown as springs 250. In some embodiments, the springs 250 are also structured to couple to the pin 226. The springs 250 are disposed at least partially between the outer sleeve 210 and the inner sleeve 220 within a recess 240 of the inner sleeve 220. The springs 250 may be configured to assist (e.g., facilitate, provide, etc.) the functionality slow-close insert assembly 200 by damping movement of the inner sleeve 220 between the first position and the second position and/or by biasing the inner sleeve 220 toward the first position.

Although the damping element is shown as a springs 250, in some embodiments, the damping element may include one or more springs, one or more dampers, and/or other mechanical damping elements. In some embodiments, when the inner sleeve 220 is in the first position, the springs 250 are in a substantially uncompressed and/or un-stretched state (e.g., substantially at equilibrium). In some embodiments, when the inner sleeve 220 is in the second position, the springs 250 are structured to extend between the retention notch 218 and the pin 226 such that the springs 250 are in a stretched or extended state. In some embodiments, when the inner sleeve 220 is in the second position and the pin 226 is disposed within the retention slot 216, the springs 250 do not have enough biasing force to disengage the pin 226 from the retention slot 216. In these embodiments, an outside force is required to disengage the pin 226 from the retention slot 216. When the pin 226 is disengaged from the retention slot 216, the springs 250 have sufficient biasing or return force to move the inner sleeve 220 to the first positon.

Still referring to FIGS. 3 and 4, the inner sleeve 220 is structured to be positioned at least partially within the outer sleeve 210. The inner sleeve includes flanges 224 that are flexible and are oriented outward at an angle radially away from the central axis in an unflexed or original position. In some embodiments, when the inner sleeve 220 is in the first position, an inner surface of the outer sleeve 210 forces the flanges 224 to flex inwards such that the flanges 224 are deflected to be oriented substantially parallel to the central axis and/or to the inner surface of the outer sleeve 210. In some embodiments, when the inner sleeve 220 is in the second position the flanges 224 automatically deflect outwards due to the biasing force. In some embodiments, and as shown in FIGS. 3 and 4, the flanges 224 each include jaws 242. The jaws 242 define a circular or partially circular opening that is centered on the central axis. The jaws 242 may deflect with the flanges 224 when the inner sleeve 220 is in the first position such that the jaws 242 grasp or couple to a portion of the hand-held sprayer 110 and/or the hose 112. When the inner sleeve 220 is in the second position, and the flanges 224 deflect outwards from the central axis due to the biasing force, the jaws 242 are structured to release or de-couple from the portion of the hand-held sprayer 110 and/or the hose 112 to allow for extension of the hose 112 from the faucet.

Figure 5:
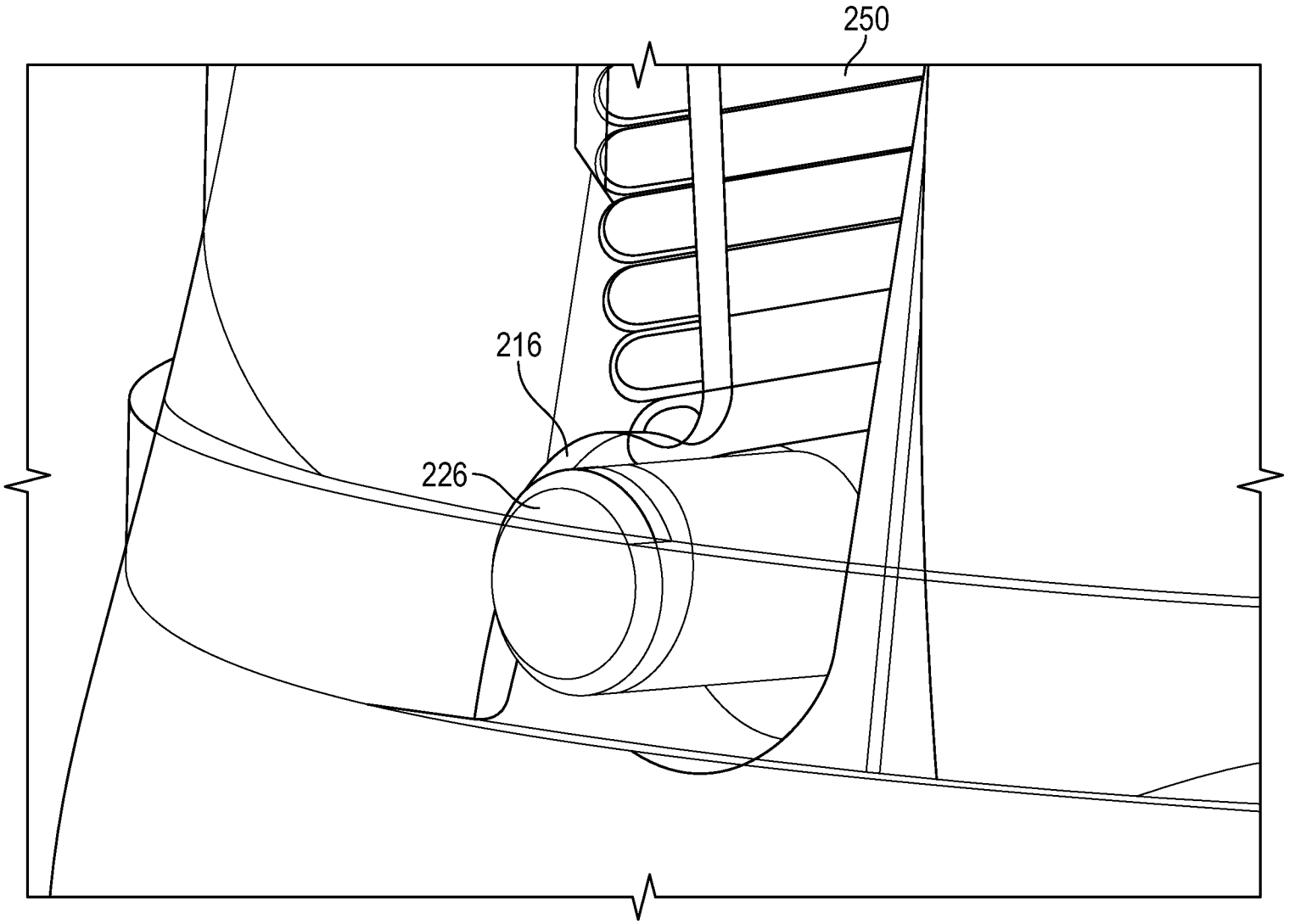
FIG. 5 is a detailed perspective view of the slow-close insert of FIG. 4.

FIG. 5 is a detailed perspective view of the slow-close insert assembly 200, according to an exemplary embodiment. The pin 226 is shown protruding at least partially through the retention slot 216. Additionally, the springs 250 are shown coupled to the pin 226

Figure 6:
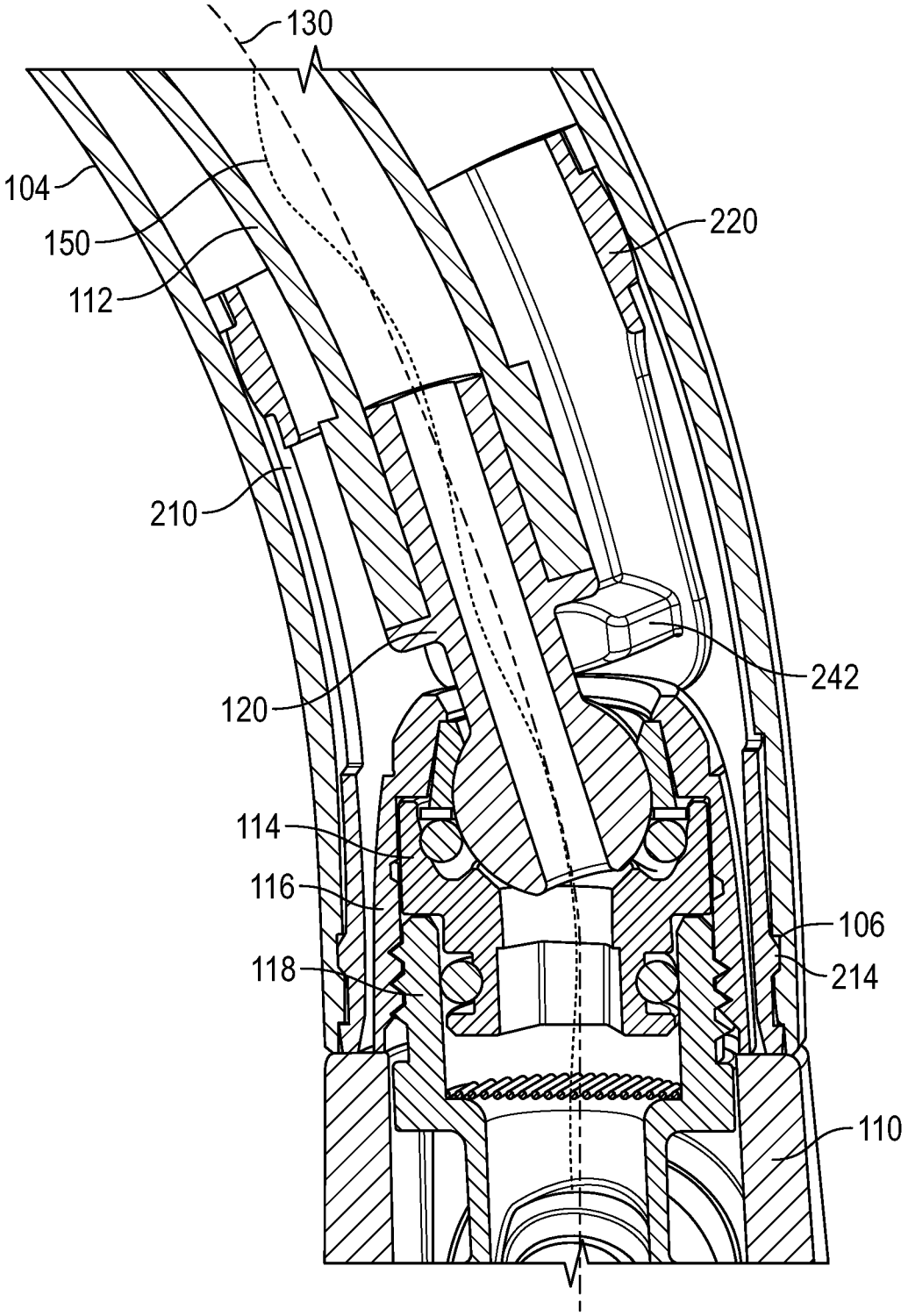
FIGS. 6-7 are cross section views of the faucet of FIG. 1 including the slow-close insert of FIG. 3.
Figure 7:
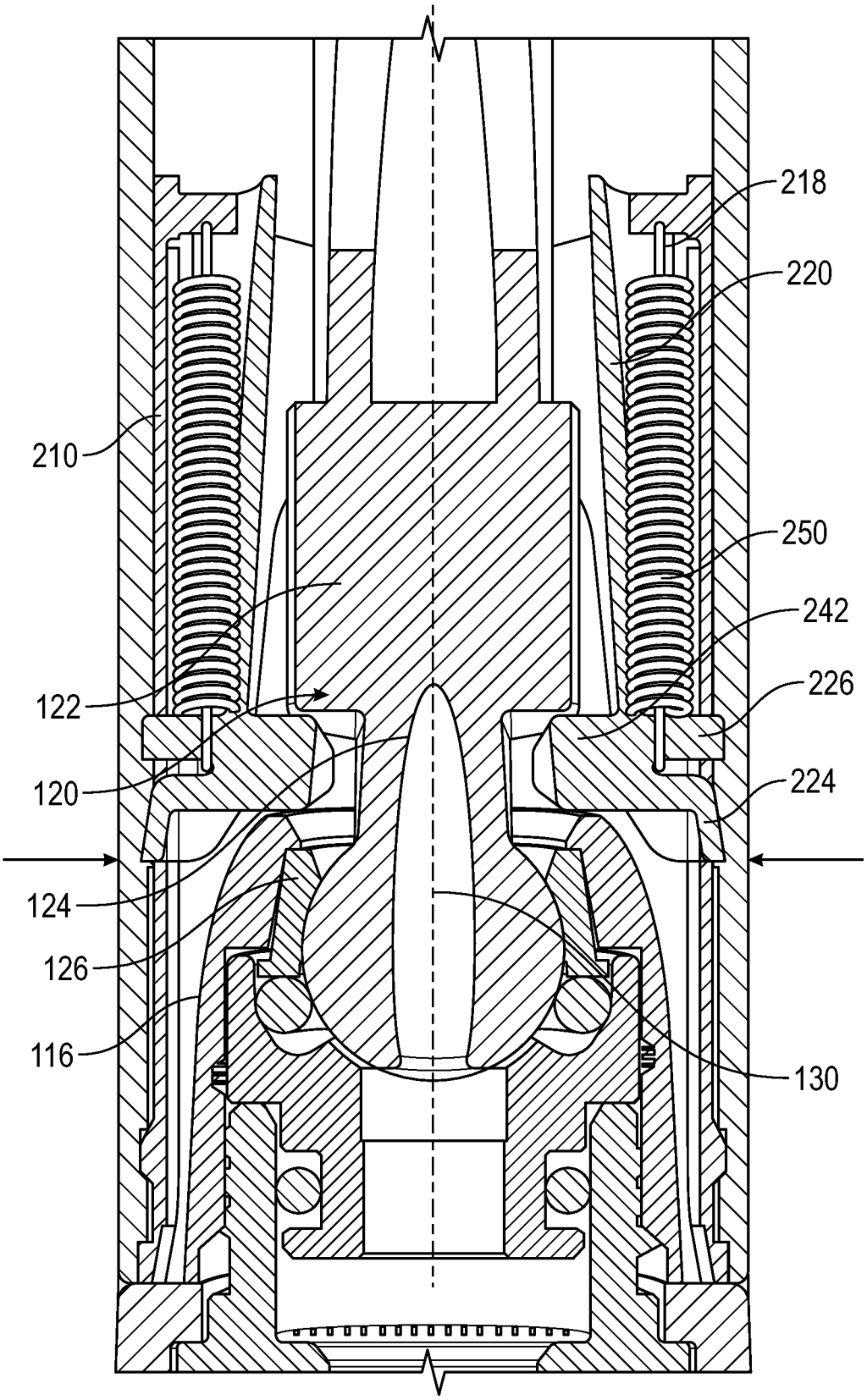

FIGS. 6-7 are cross section views of the faucet of FIG. 1 including the slow-close insert assembly 200 of FIG. 3. The slow-close insert assembly 200 is shown disposed within the spout 104. The hose 112 at least partially extends through the central axis of the slow-close insert assembly. The hand-held sprayer 110 is also at least partially disposed within and/or below (e.g., downstream) the slow-close insert assembly 200.

Referring specifically to FIG. 6, the hand-held sprayer 110 is shown to include a socket portion 114, a conical nut 116, and a water chamber portion 118, and a ball fitting 120. The socket portion 114 is structured to receive the ball fitting 120. The ball fitting 120 is structured to freely rotate within the socket portion 114. The ball fitting is also structured to couple to the hose 112. The socket portion 114 may be sealable coupled to the water chamber portion 118. The conical nut 116 is coupled (e.g., threadably coupled) to the water chamber portion 118 such that the conical nut 116 compresses the socket portion 114 into the water chamber portion 118 forming a fluid-tight seal therebetween.

Still referring to FIG. 6, a flow path 150 is shown. The flow path 150 generally depicts where water flows within the faucet assembly 100. In particular, the flow path 150 is within the hose 112, the ball fitting 120, the socket portion 114, the water chamber portion 118, and exits the hand-held sprayer 110 at a distal end.

As shown in FIG. 6, the inner sleeve 220 is in the first position and the jaws 242 are grasping a portion of the ball fitting 120. Additionally, the outer sleeve 210 is structured to couple to the inner portion of the spout 104 in a snap-fit arrangement. Specifically, the tab 214 is disposed within a tab slot 106 of the spout 104.

Now referring to FIG. 7, the ball fitting 120 is shown to include a proximal portion 122, a central portion 124 and a distal portion 126. The proximal portion 122 is structured to receive a portion of the hose 112. The central portion 124 has a radius that is smaller than the radius of the proximal portion such that the jaws 242 can grasp the ball fitting 120 at the central portion 124. The distal portion 126 is structured to have a substantially spherical shape such that the ball fitting 120 can freely rotate within the socket portion 114.

Still referring to FIG. 7, the outer sleeve 210 is shown to apply a radially inward force (shown by arrows) on the inner sleeve 220 such that the flanges 224 are deflected inwards towards a central axis 130. In this position, the jaws 242 grasp the hand-held sprayer 110 at ball fitting 120 (e.g., at the central portion 124 and/or between the proximal portion 122 and the conical nut 116).

Figure 8:
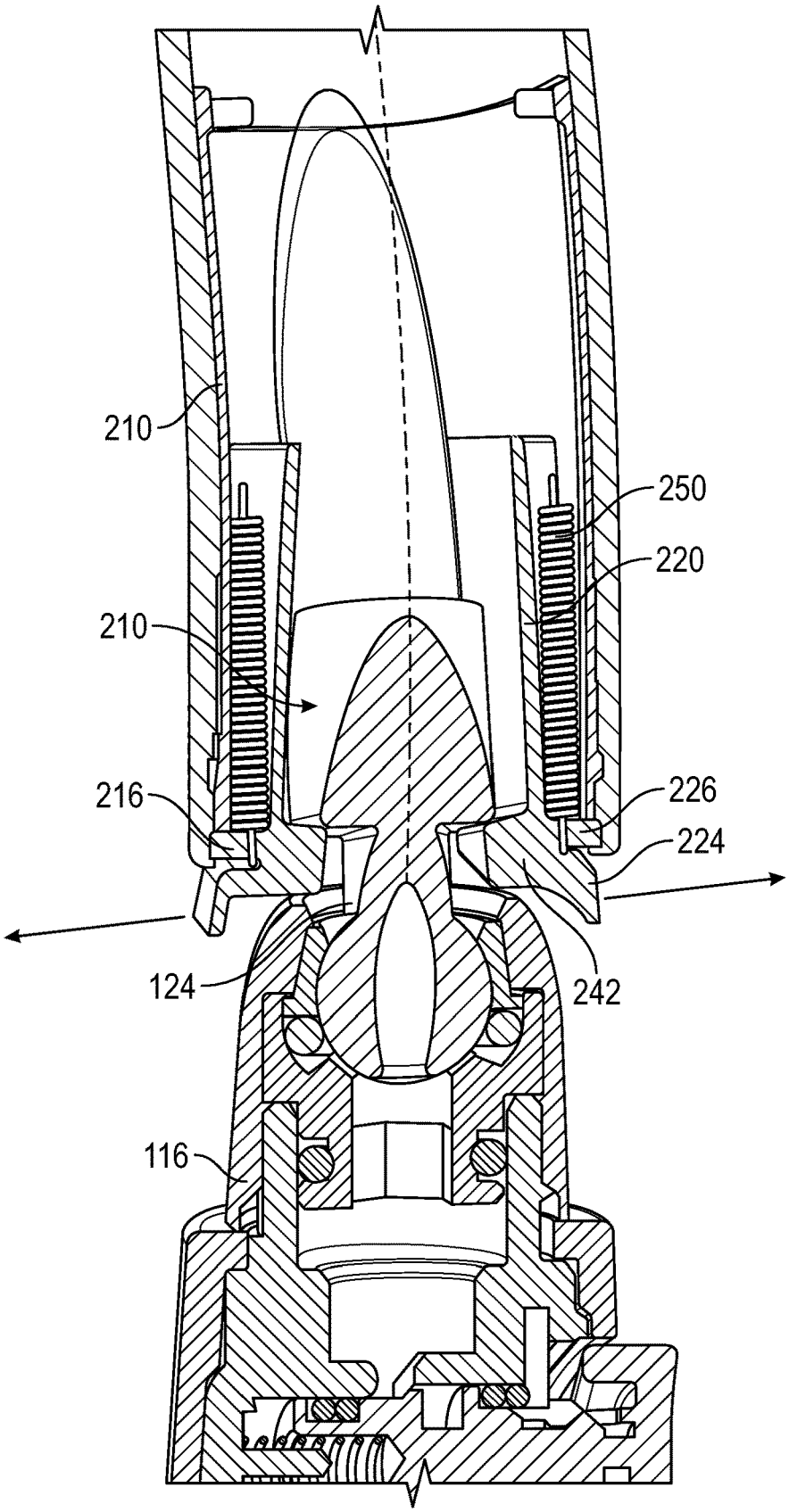
FIG. 8 is a cross section view of the faucet of FIG. 1 including the slow-close insert of FIG. 4.

FIG. 8 is a cross section view of the faucet assembly 100 including the slow-close insert assembly 200. When the hand-held sprayer 110 is removed from the spout 104, the inner sleeve 220 transitions to the second position, as shown in FIG. 8. As the inner sleeve 220 transitions form the first position to the second position, the springs 250 at least partially resist the movement of the inner sleeve. The flanges 224 are deflected outwards (e.g., away from the central axis 130) by the biasing force (shown by arrows). The jaws 242 are also deflected outwards and the opening defined by the jaws 242 is wide enough such that the proximal portion 122 (and the hose 112) can fit through the opening defined by the jaws 242. Accordingly, the hand-held sprayer can be operated to dispense water in a plurality of directions and/or a plurality of spray modes.

Still referring to FIG. 8, when the hand-held sprayer 110 is returned to the spout 104 at the docked position, the conical nut 116 is structured to force the pin 226 out of the retention slot 216. As the pin 226 is removed from the retention slot 216, the central portion 124 of the ball fitting 120 aligns with the jaws 242 such that the jaws 242 may deflect inwards without interference from the larger diameter proximal portion 122. The springs 250 also begin operating the inner sleeve 220 to the first position in a slow-close action. As the inner sleeve 220 moves to the first position, the outer sleeve 210 applies a radially inward force to deflect the flanges 224 inward causing the jaws 242 to grasp the hand-held sprayer 110 at the central portion 124 of the ball fitting 120. The slow-close action created by the springs 250 is substantially slow and free of excess force or perturbations. In some embodiments, as the inner sleeve 220 returns to the first or docked position, the outer sleeve 210 supplies a frictional interference to assist in the slow-close action of the inner sleeve. In this manner, the disclosed insert assembly 200 facilitates extension and docking of a hand-held sprayer in a more reliable and consistent manner, as compared to other faucets with pull-out sprayers.

As utilized herein with respect to numerical ranges, the terms "approximately," "about," "substantially," and similar terms generally mean+/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

It is important to note that any element disclosed in one embodiment may be incorporated or utilized with any other embodiment disclosed herein. For example, the slow-close insert assembly 200 described herein may be incorporated in the faucet assembly 100 described herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A slow close mechanism, comprising:

an outer sleeve coupled to an inner surface of a faucet;

an inner sleeve positioned within the outer sleeve and operable between an open position and a closed position, the inner sleeve including:

a plurality of flanges oriented outward radially away from a center of the inner sleeve; and a plurality of jaws coupled to the flanges and defining a central opening therebetween, wherein the jaws are configured to engage a portion of a hand-held sprayer when the inner sleeve is in the closed position and release the portion of the hand-held sprayer when the inner sleeve is in the open position; and a damping element configured to assist the slow close mechanism when the inner sleeve transitions between the open position and the closed position, wherein assisting the slow close mechanism comprises at least one of damping movement of the inner sleeve between the open position and the closed position or biasing the inner sleeve into the closed position, wherein the inner sleeve is wholly received within the outer sleeve when the inner sleeve is in the closed position, and wherein the inner sleeve is partially received within the outer sleeve when the inner sleeve is in the open position.

2. The slow close mechanism of claim 1, further comprising a second damping element, the two damping elements disposed opposite one another along a length of the outer sleeve.

3. The slow close mechanism of claim 1, wherein the outer sleeve further comprises a track positioned on a first surface of the outer sleeve and extending longitudinally along a length of the outer sleeve.

4. The slow close mechanism of claim 3, wherein the inner sleeve further comprises a protrusion positioned at least partially within the track, and wherein the protrusion is selectively repositionable within the track when the inner sleeve is repositioned between the open position and the closed position.

5. The slow close mechanism of claim 1, wherein the inner sleeve is at least partially received within the outer sleeve and slidably repositionable within the outer sleeve.

6. The slow close mechanism of claim 1, wherein the damping element biases the plurality of flanges outward when the inner sleeve is in the open position.

7. The slow close mechanism of claim 1, wherein the faucet applies a radially inward force on the inner sleeve to deflect the plurality of flanges inwards to maintain contact between the jaw and the portion of the hand-held sprayer when the inner sleeve is in the first position.

* * * * *